United States Patent [19]

Pattison

[11] Patent Number: 4,991,788

[45] Date of Patent: Feb. 12, 1991

[54] FOLDABLE SPOOL

[76] Inventor: Dewayne Pattison, 820 Yellowstone, Grapevine, Tex. 76051

[21] Appl. No.: 414,689

[22] Filed: Sep. 29, 1989

[51] Int. Cl.[5] ..... B65H 75/18

[52] U.S. Cl. ..... 242/85.1; 242/96

[58] Field of Search ..... 242/85.1, 85, 96, 115; 30/173, 174, 194, 244

[56] References Cited

U.S. PATENT DOCUMENTS

| | | | |
|---|---|---|---|
| 67,370 | 7/1867 | Stevens | 30/244 |
| 404,732 | 6/1889 | Reisinger | 30/194 |
| 2,833,075 | 5/1958 | Herron | 242/85.1 X |
| 3,901,458 | 8/1975 | Kuncz, Jr. | 242/85.1 |
| 4,261,529 | 4/1981 | Sandberg et al. | 242/85.1 |

FOREIGN PATENT DOCUMENTS

| | | | |
|---|---|---|---|
| 600747 | 7/1934 | Fed. Rep. of Germany | 242/85.1 |
| 838133 | 11/1938 | France | 242/85.1 |

*Primary Examiner*—Stanley N. Gilreath
*Attorney, Agent, or Firm*—Johnson & Gibbs

[57] ABSTRACT

A foldable spool for winding an elongate flexible member from which the coiled flexible member can be readily removed after winding. The spool includes a first elongate arm having a first tine located at one end and a second tine located at the opposite end. A second elongate arm includes a first tine located at one end and a second tine located at the opposite end. The central portion of the first arm is pivotally connected to the central portion of the second arm so that the respective first tines thereof form a first fork and the respective second tines thereof form a second fork to allow winding of the elongate flexible member. The wound coil is removed by pivoting one arm with respect to the other to separate the tines and open the forks.

13 Claims, 3 Drawing Sheets

FOLDABLE SPOOL

BACKGROUND OF THE INVENTION

1. Field of the Invention

The invention relates to a spool for winding an elongate flexible member and, more particularly, to a foldable spool from which the coiled flexible member can be readily removed after winding.

2. History of the Prior Art

In daily life, it is frequently necessary to use elongate flexible members such as electrical cords, ski ropes, garden hoses, yarn, and dog leashes. In dealing with such structures, it is very awkward and inconvenient to store, transport or use the entirety of a long flexible member without having the strands tangle up. In particular, the storage of unwound flexible member takes up a large amount of space and creates a hazard. To cope with this storage problem, different kinds of spools have been used to wind the flexible member into a coil. However, once it is wound up onto a reel for storage, it is also difficult and time consuming to unwind and remove the flexible member from the spool in order to use that flexible member. Thus, the alternate use and storage of the flexible member requires repeated unreeling and reeling. This consumes a large amount of time and is also inconvenient to the user In an effort to cope with problems encountered with the storage of elongated flexible members on conventional reels, prior art solutions have proposed multi-element articulatable reels which either collapse, fold or have a separable end piece allowing the removal of coiled flexible members after winding. Problems inherent with these devices are that they are complicated, expensive to manufacture, difficult to release the wound flexible member, and most are not portable. For example U.S. Pat. No. 410,405 to Epple discloses a multi-part foldable reel which is collapsible and requires a spring means to hold the reel apart and to attach it to a stationary base. Similarly, U.S. Pat. No. 2,382,968 to Berman discloses an adjustable reel and collapsible support. However, both the Epple and the Berman devices are complicated and difficult to use. U.S. Pat. No. 2,057,728 to lester discloses a clamp mounted yarn reel with four arms which are foldable with respect to one another. Each of the Epple, Berman and Lester devices are designed for semi-permanent mounting and are not truly portable, thus limiting their utility for convenient stand storage. U.S. Design Pat. No. 264,806 to Russell shows a one piece coil winder which is readily portable but it is very difficult to remove the wound member for reuse after winding.

The devices disclosed in each of the prior art patents are either multi-component, difficult to use or not readily portable. The present invention overcomes many of the prior art problems as discussed above.

SUMMARY OF THE INVENTION

The foldable spool of the present invention comprises a first elongate arm having a first tine located at one end and a second tine located at the opposite end, a second elongate arm having a first tine located at one end, and a second tine located at the opposite end and means for pivotally connecting the central portion of the first arm to the central portion of the second arm so that the respective first tines thereof form a first fork and the respective second tines thereof form a second fork to allow winding of an elongate flexible member therearound.

In another aspect, the foldable spool of the present invention includes a pair of identical elongate arms pivotally connected to one another to form a fork on opposite ends thereof to receive a flexible member wound thereon and articulatable with respect to one another to separate opposite tines of each fork allowing ready removal of the wound member.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Figure 1:
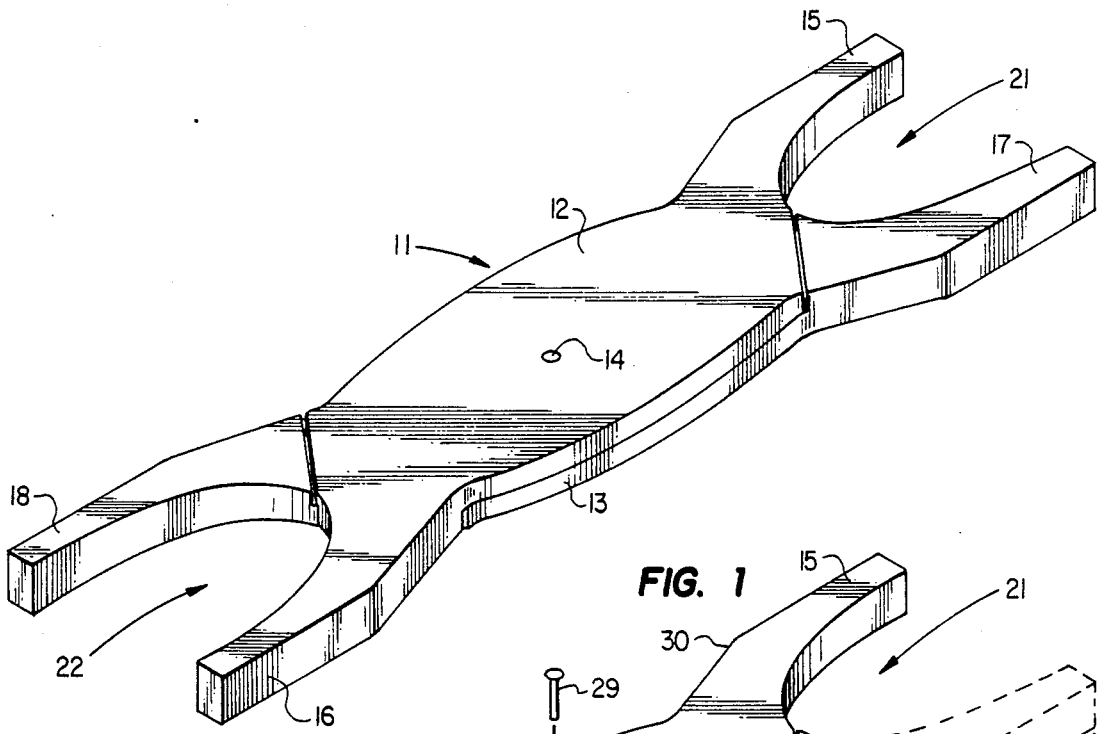
FIG. 1 is a perspective view, showing a foldable spool constructed in accordance with the present invention in a closed configuration.

Referring first to FIG. 1, there is shown a perspective view of a foldable spool 11 constructed in accordance with the teachings of the present invention. The spool 11 includes a first elongate arm 12 and a second elongate ar 13 which are pivotally connected to one another through hinge 14 so that each arm is articulatable with respect to the other. The first elongate arm 12 contains a first tine 15 on one end and a second tine 16 on the opposite end. The second elongate arm 13 contains a first tine 17 on one end and a second tine 18 on the opposite end. When both arms are in their folded configuration as shown in FIG. 1, the first tine 15 of the first elongate arm 12 and the first tine 17 of the second elongate arm 13 forms a first fork 21. Similarly, the second tine 18 of the second elongate arm 13 and the second tine 16 of the first elongate arm 12 form a second fork 22. The first fork 21 and the second fork 22 are located on the opposite ends of the portable spool 11. The elongate arms can be made up of wood, metal, metal alloy, polymeric plastics, rubber or similar material. Materials which have a bulk density less than that of water, such as certain polymeric materials, are especially useful to construct foldable spools to be employed for winding aquatic ropes.

Figure 2:
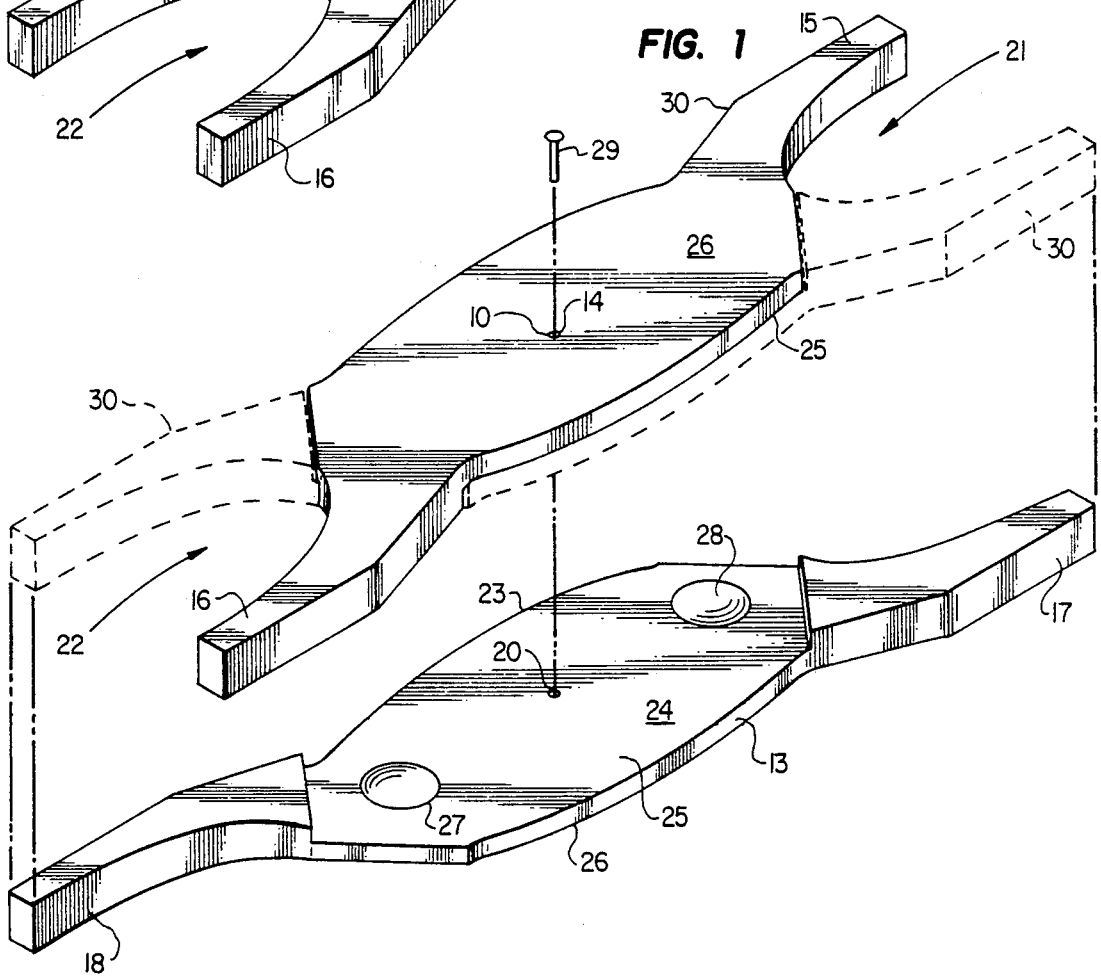
FIG. 2 is a perspective view of the foldable spool shown in FIG. 1 with its two arms exploded and separated from one another.

Referring now to FIG. 2, there is shown an exploded view of the spool 11 with the first elongate arm 12 separated from the second elongate arm 13. The phantom lines show the position of the second elongate arm 13 when the spool is assembled. As is shown in the exploded view, the hinge 14 is formed by a pin 29 positioned through hole 10 of the first elongate arm 12 and hole 20 of the second elongate arm 13. Each elongate arm is formed of a body 23 with two tines located on opposite ends and joined thereto by a shoulder region 30. Body 23 has a recess 24 formed in the central region of one surface of the arm and extending toward the opposite surface 26. The central recess 24 of the second elongate arm 13 engages a comparable recess 24 in the central region on the opposite side of the first elongate arm 12 in cooperative engagement with one another. The planar surface of the central recess 24 and the planar outer surface 26 of the body 23 are generally parallel to one another and occupy substantially the entire central portion of the elongate arms 12 and 13. The depth of the recessed surface 24 is equal to about half of the thickness of the body 23 of the arms 12 and 13.

The recessed surfaces 24 of each body 23 is further provided with a circular depression 27 on one end and a circular protrusion 28 on the opposite end located symmetrically with respect to hole 20 and with respect to one another. The circular protrusion 28 of the second elongate arm 13 engages the circular depression 27 of first elongate arm 12, while the circular protrusion 28 of the first elongate arm 12 engages the circular depression 27 of the second elongate arm 13. These respective engagements of depression and protrusion hold the parts with respect to one another in the closed and condition to allow the winding of flexible members thereon. The structure of the first elongate arm 12 is identical to the structure of the second elongate arm 13 which greatly simplifies manufacture thereof. As can be seen from FIG. 2, the two elongate arms are secured together by pin 29 positioned through the hole 10 of the first elongate arm 12 and the hole 20 of the second elongate arm 13 to form the foldable reel assembly.

Figure 3:
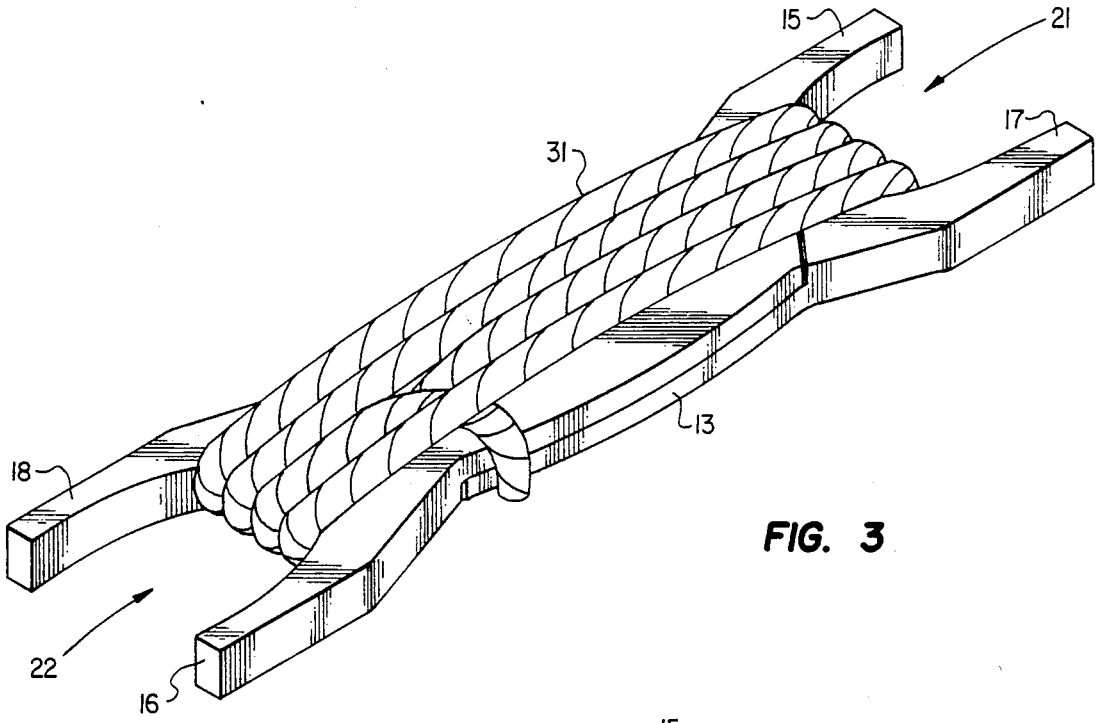
FIG. 3 is a perspective view of the foldable spool of FIG. 1 with a flexible member wound thereon.
Figure 4:
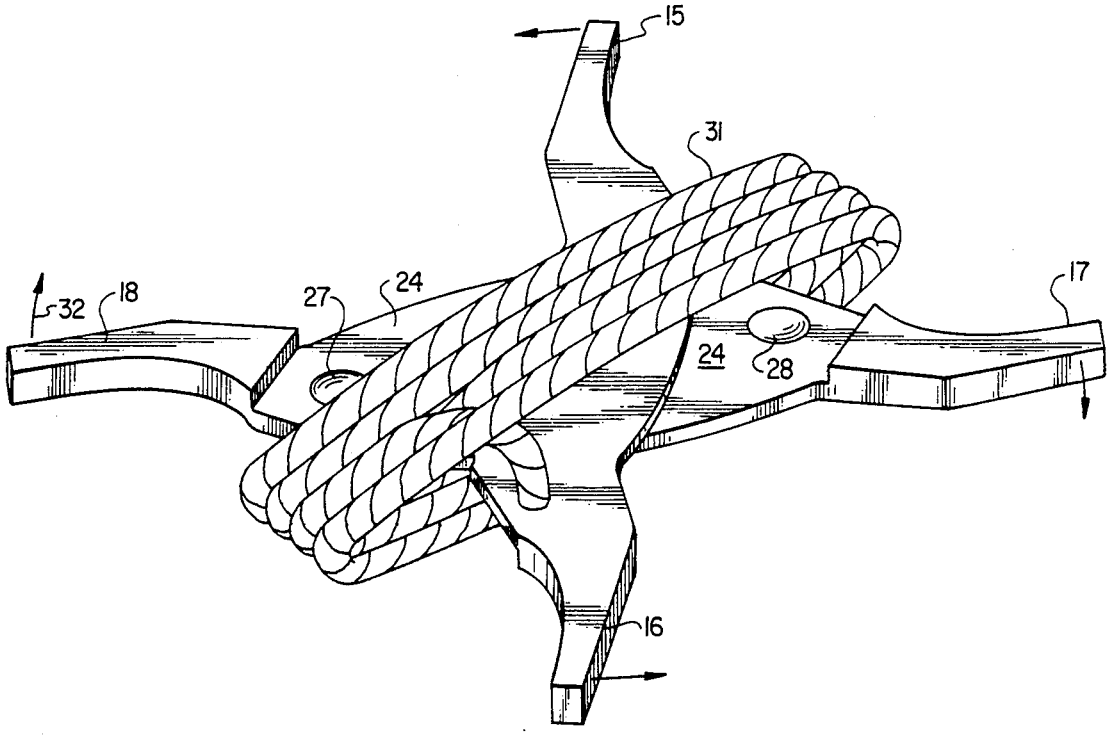
FIG. 4 is a perspective view of the foldable spool shown in FIG. 1 with the flexible member wound thereon and with two arms in an open configuration.

FIG. 3 shows the foldable spool 11 having an elongate flexible member 31 wound thereon by passing the flexible member alternately through the first fork 21 and the opposite second fork 22. In this fashion the foldable spool serves as a conventional spool to hold a flexible member such as a rope, garden hose, yarn, or fishing line. As discussed above, the foldable reel of FIG. 3, having a flexible member wound thereon, will enable ready removal of the coiled flexible member by articulating one arm with respect to the other as illustrated in FIG. 4. As shown there, the two arms are pivoted with respect to one another about their hinged joinder at pivot 14 in the direction shown by arrow 32 to open their respective forks. This action separates tine 15 from tine 17, as well as tine 18 from tine 16, to open forks 21 and 22 and allow the removal of the coiled flexible member 31 from the spool without unwinding it. Application of a force to tines 15 and 17 in opposite directions allows separation thereof by causing the circular protrusions 28 and the circular depressions 27 to disengage from one another. Thus, separation of the respective tines of the forks permits easy removal of the coiled flexible member from the spool onto which it was coiled.

Figure 5:
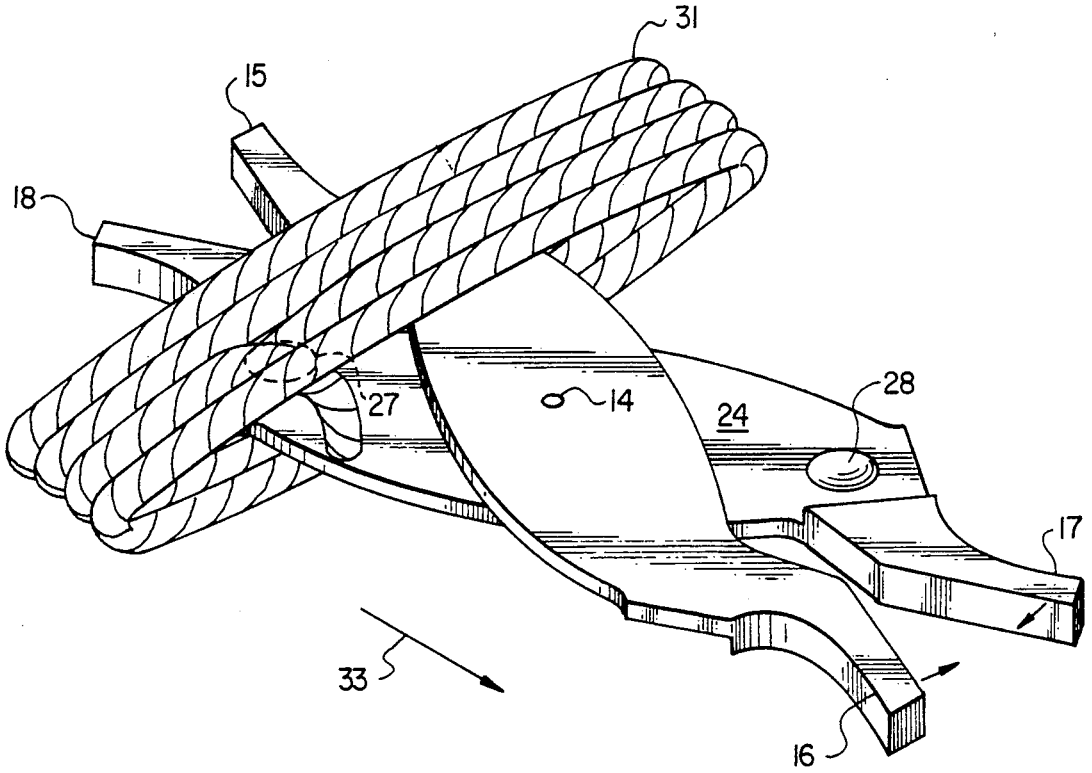
FIG. 5 is a perspective view of the foldable spool shown in FIG. 1 with its two arms folded to opposite extremes in the open configuration to allow ready removal of the coiled flexible member.

FIG. 5 shows that the two arms 12 and 13 open to their extremes and movement of the two arms in the direction shown by arrow 33 removes the spool from within the coiled rope while allowing it to remain coiled.

As discussed above, it is clear that the present portable, foldable spool can be used to easily wind a flexible member. It can also be easily removed from the wound flexible member to leave the coil intact and reuse the spool to wind another coil. The circular protrusions and the corresponding circular depressions hold the two arms together to prevent accidental release of the wound flexible member until desired. Thus it is seen that the present invention is a great improvement over the prior art discussed in that it is simple to wind the flexible member, simple to remove the wound flexible member in a coil, and it is portable and inexpensive to manufacture.

It is thus believed that the operation and construction of the present invention will be apparent from the foregoing description. Although the method and apparatus shown and described has been characterized as being preferred, it will be obvious that various changes and modifications may be made therein without departing from the spirit and scope of the invention as defined in the following claims.

What is claimed is:

1. A foldable spool comprising:

a first elongate arm having a first tine located at one end and a second tine located at the opposite end;

a second elongate arm having a first tine located at one end and a second tine located at the opposite end;

means for pivotally connecting a central portion of said first arm to a central portion of said second arm so that the arms are pivoted between a first position wherein the respective first tines thereof form a first fork and the respective second tines thereof form a second fork to allow winding of an elongate flexible member therearound to form a coil, and a second position wherein said arms are pivoted to allow removal of the coil; and means for releasably holding said arms in said first position.

2. A foldable spool as recited in claim 1 wherein said pivotal means comprises a hinge formed by a pin positioned through centrally located holes in said first and second arms.

3. A foldable spool as recited in claim 1 wherein each of said first and second arms includes a central body portion and a recessed surface in one side thereof.

4. A foldable spool comprising:

a first elongate arm having a first tine located at one end and a second tine located at the opposite end;

a second elongate arm having a first tine located at one end and a second tine located at the opposite end; and means for pivotally connecting the central portion of said first arm to the central portion of said second arm so that the respective first tines thereof form a first fork and the respective second tines thereof form a second fork to allow winding of an elongate flexible member therearound wherein each of said first and second arms includes a central body portion and a recessed surface in one side thereof, and each said central recess further includes at least one circular depression on one end and at least one circular protrusion on the opposite end located symmetrically with respect to the centrally located holes through said central recesses and with respect to one another.

5. A foldable spool as recited in claim 4 wherein said foldable spool is formed of a material having a bulk density less than that of water whereby the spool will float on water.

6. A foldable spool comprising:

a first elongate arm including a body portion having a first tine located at one end and a second tine located on the opposite end, said first arm having a recessed surface formed in a central region of said body portion;

a second elongate arm including a body portion having a first tine located at one end and a second tine located on the opposite end, said second arm having a recessed surface formed in a central region of said body portion;

means for pivotally connecting a central portion of said first arm to a central portion of said second arm so that the arms are pivoted between a first position wherein the respective first tines thereof form a first fork and the respective second tines thereof form a second fork to allow winding of an elongate flexible member therearound to form a coil, and a second position wherein said arms are pivoted to allow removal of the coil; and means for releasably holding said arms in said first position.

7. A foldable spool as recited in claim 6 wherein said pivotal means comprises a hinge formed by a pin positioned through centrally located holes extending through the body portions of said first and second arm.

8. A foldable spool as recited in claim 6 wherein the depth of said recess in said body portions are each equal to about half of the thickness of the body of said arms.

9. A foldable spool as recited in claim 6 wherein said central recess of said first arm engages said central recessed surface on said second arm.

10. A foldable spool comprising:

a first elongate arm including a body portion having a first tine located at one end and a second tine located on the opposite end, said first arm having a recessed surface formed in the central region of said body portion;

a second elongate arm including a body portion having a first tine located at one end and a second tine located on the opposite end, said second arm having a recessed surface formed in the central region of said body portion;

means for pivotally connecting the central portion of said first arm to the central portion of said second arm so that the respective first tines thereof form a first fork and the respective second tines thereof form a second fork to allow winding of an elongate flexible member therearound; and wherein each of said central recesses further includes at least one circular depression on one end and at least one circular protrusion on the opposite end located symmetrically with respect to the holes formed through said central recessed surfaces and with respect to one another.

11. A foldable spool as recited in claim 10 wherein said foldable spool is formed of a material having a bulk density less than that of water whereby the spool will float on water.

12. A foldable spool comprising:

a first elongate arm having a first tine located at one end and a second tine located on the opposite end, said first arm having a recessed surface in its central region with a centrally located hole formed therethrough, said recessed surface having at least one circular depression on one end and at least one circular protrusion on the opposite end located symmetrically with respect to the central hole through said recessed surface and with respect to one another;

a second elongate arm having a first tine located at one end and a second tine located on the opposite end, said second arm having a recessed surface in its central region with a centrally located hole formed therethrough, and said recessed surface having at least one circular depression on one end and at least one circular protrusion on the opposite end located symmetrically with respect to the central hole through said recessed surface and with respect to one another; and a hinge formed by a pin positioned through said central hole through said first arm and said central hole through said second arm for pivotally connecting the central recessed surface of said first arm to the central recessed surface of said second arm so that said circular protrusion of said first arm engages said circular depression of said second arm and said circular protrusion of said firm arm engages said circular protrusion of said second arm whereby the respective first tines of both arms form a first fork and the respective second tines of both arms for a second fork to allow winding of an elongate flexible member therearound.

13. A foldable spool as recited in claim 12 wherein said foldable spool is formed of a material having a bulk density less than that of water whereby the spool will float on water.

* * * * *